United States Patent [19]

Yoshikawa

[11] 4,159,153

[45] Jun. 26, 1979

[54] LATCH DEVICE FOR DRAWERS

[75] Inventor: Fumio Yoshikawa, Naganoshi, Japan

[73] Assignee: Matushiro Kinzoku Seisakujo Co., Ltd., Naganoshi, Japan

[21] Appl. No.: 847,943

[22] Filed: Nov. 2, 1977

[30] Foreign Application Priority Data

Nov. 2, 1976 [JP] Japan ..... 51-132229

[51] Int. Cl.[2] ..... A47B 88/00

[52] U.S. Cl. ..... 312/333; 312/222; 312/319; 292/DIG. 4

[58] Field of Search ..... 312/333, 222, 319, 221; 292/DIG. 4

[56] References Cited

U.S. PATENT DOCUMENTS

| | | | |
|---|---|---|---|
| 1,000,268 | 8/1911 | Jadronja | 312/333 |
| 1,139,940 | 5/1915 | Westmoreland | 312/221 |
| 1,309,310 | 7/1919 | Voight | 292/DIG. 4 |
| 1,462,780 | 7/1923 | Yanchik | 312/333 |
| 2,817,554 | 12/1957 | Hasselmark | 292/DIG. 4 |
| 2,919,966 | 1/1960 | Preston | 312/319 |
| 3,836,222 | 9/1974 | Kuntze | 312/333 |

OTHER PUBLICATIONS

IBM Technical Disclosure Bulletin, Dec. 1974.

*Primary Examiner*—Victor N. Sakran

*Attorney, Agent, or Firm*—Birch, Stewart, Kolasch and Birch

[57] ABSTRACT

A novel latch device for drawers which comprises a prolonged element formed on the support plate, fixed vertically at a rear portion of the drawer casing, at its upper front end relative to the forward direction of the drawer, a notch at the front upper edge of said support plate, a horizontal lever in close contact with the upper part of one side of said support plate, a beak-like hook, on the lower front end of said horizontal lever, positioned so as to engage in the lower end of said prolonged part, a notch for locking on the rear end edge of the horizontal lever, a loose hole near the center of the horizontal lever to axially hold the lever on contact with the support plate, a spring applying a downward and backward tension on the drawer hook, a lock-releasing lever which is placed on the upper part of the other side of the above-mentioned support plate, and which is provided with a projected portion immediately behind the drawer hook, a latch-catching element disposed at its near edge, a bend disposed on the front upper edge over the horizontal lever, a loose hole disposed near its center to axially hold the support plate, a spring means for pulling the projected portion in the forward-downward direction, a latch disposed at the rear end part of the support plate which is movable around an axis and positioned so as to engage in the notch for locking on the horizontal lever, and a spring means for applying pressure therebehind.

1 Claim, 14 Drawing Figures

LATCH DEVICE FOR DRAWERS

BACKGROUND AND SUMMARY OF THE INVENTION

The present invention relates to a novel latch device for drawer boxes, especially those for cash registers.

The present invention, defined in more detail, relates to a latch device which is capable of allowing the drawer (cash register drawer box), when pushed into the cash register drawer casing, to be latch-locked under imposition of a forwarding tension by means of a spring with its one end fixed on the drawer casing, and which is capable of allowing the subsequent push on the drawer box to activate the latch-lock releasing mechansim provided on the latch device.

Improvements of electronic circuits have enabled the cash register recording section to work with an extremely low power consumption. The merit of low power consumption is, however, cancelled by the necessity of large electric current required for electrically driving the latch mechanism securing efficient operation of the cash register drawer.

The latch device obtainable from this invention is capable of releasing the latch-lock merely by means of a mechanical latch-lock releasing mechanism, and of working under the action of a weak pushing force, without any power supply or solenoid mechanism, so that the present invention is able to offer an excellent latch device at extremely low cost.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

FIGS. 6 and 7 are the left- and right-side views of the latch device when the drawer has been pushed in;

DESCRIPTION OF THE PREFERRED EMBODIMENTS

Figure 1:
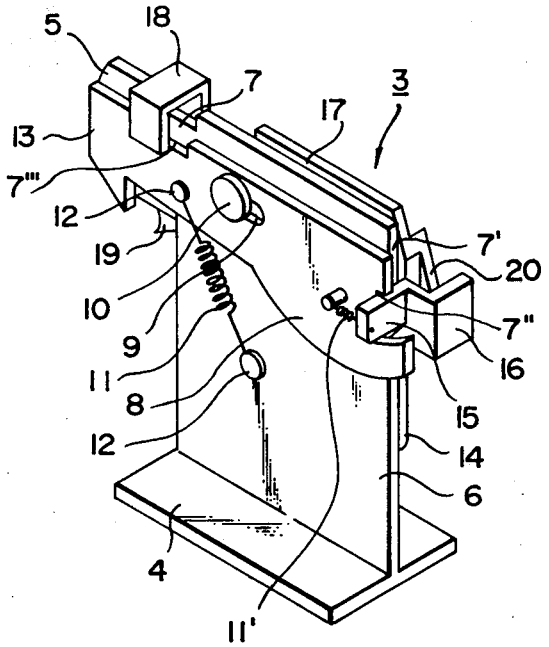
FIG. 1 is an example of a latch device viewed from the left side.
Figure 2:
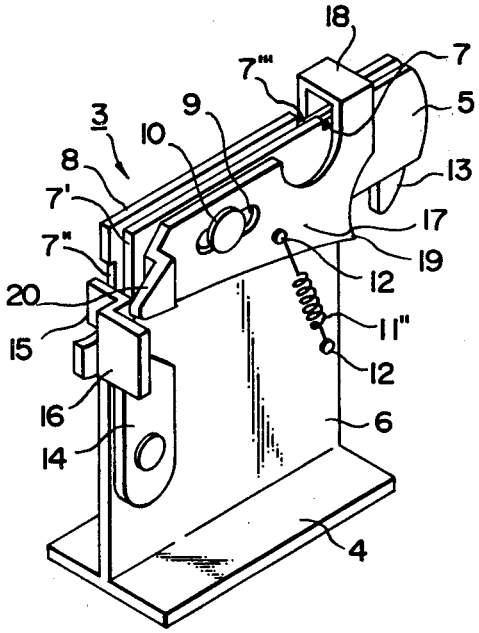
FIG. 2 is an example of a latch device viewed from the right side.
Figure 3:
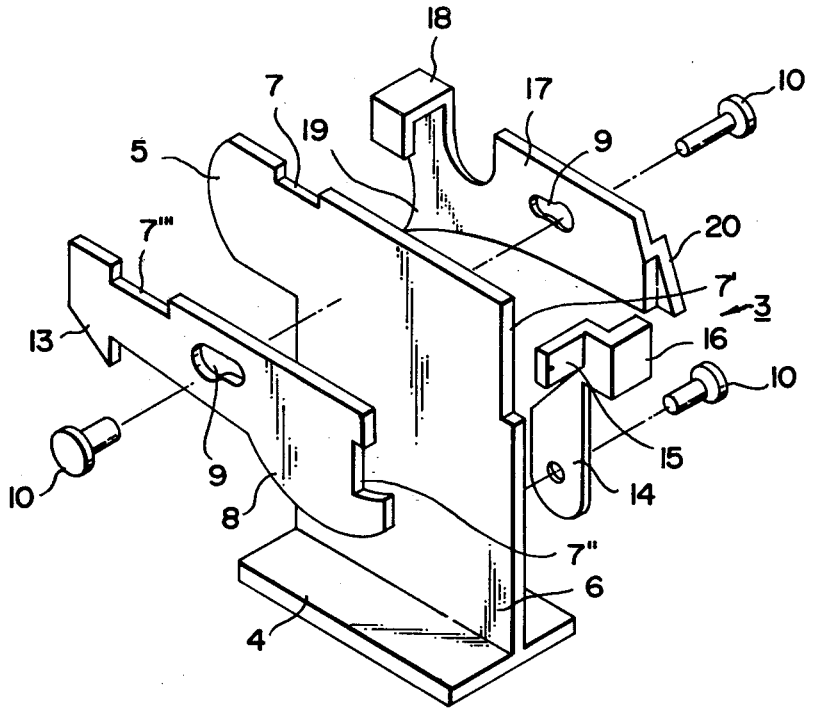
FIG. 3 is a disassembled drawing of the latch device.

One example of a suitable latch device will be illustrated with the aid of FIGS. 1 and 2. The stopper 2 on the cash storing drawer 1 is locked by the latch device 3. This latch device consists of a base plate 4 and a support plate 6 vertically standing substantially at the center of the base plate 4. The support plate 6 has a generally square or rectangular shape with a part projecting backward on the upper portion thereof, designated as the prolonged part 5. The support plate is provided on its upper edge with the downward extending notches 7 and 7' near the rear end and at the front end, respectively. The horizontal lever 8 is attached loosely and flatly with the rivet 10 to the vicinity of the projected part 5 on the other side of the support plate 6 via the long elliptical hole 9. The spring 11 is applied between the pin 12 projecting near the center behind the long elliptic hole 9 of the horizontal lever 8 and the pin 12' projecting at the center of the support plate 6. The rear lower end of the horizontal lever 8 is projected downward to form the hook 13 in an acute angle. The horizontal lever 8 is provided, on the front edge thereof, with the notch 7'' substantially in the form of "C". This notch 7'' catches the latch hook 15 provided on the latch component 14. This latch component 14 is attached on one side of the support plate 6 via the rivet 10. This latch component 14 is provided with the hook 16, which extends horizontally to the outer side from the front vertical edge of the support plate 6, and with a latch hook 15, which extends in the opposite direction to the hook 16 a little over the notch 7' of the support plate 6. The spring 11' is applied between the end of the latch hook 15 of the latch component 14 and the pin 12 projecting from the front center of the horizontal lever 8. Near the notch 7 on the rear upper edge of the horizontal lever 8 there is the rather wide notch 7'''. The lock-releasing lever 17 is attached loosely to near the upper part of one side of the support plate 6 with the rivet 10 extending through the long elliptic hole 9 positioned almost horizontally. The spring 11'' is applied between the pin 12 projecting near the rear lower end of the lock-releasing lever 17 and the pin 12 projecting near the rear end of one side of the support plate 6. The rear upper end of the lock-releasing lever 17 forms the bend 18 over both the support plate 6 and the horizontal lever 8, and the rear lower end forms the projected part 19 extending at a slight slant from the lower end of the prolonged part 5. The front part of the lock-releasing lever 17 forms the triangular latch-catching part 20, with a rounded tip positioned close to the hook 16 of the latch component 14.

The latch device thus set up is placed near the end of the cash storing drawer casing 21 by fixing the base plate 4 on the inner bottom surface. The cash storing drawer casing 21 is equipped with a spring 11''' with a moderate tension which is fixed, for example, on the back wall of the cash storing drawer casing 21. The cash storing drawer box 1, which freely slides within the casing 21, has its back wall provided with a stopper 2, whose horizontally prolonged end is positioned to project upward. This stopper 2 catches the hook 13 of the horizontal lever 8 when the cash storing drawer box 1 has been completely pushed into the cash storing drawer casing 21. It is possible to cause an alarm to work as the cash storing drawer box 1 begins to be withdrawn, by attaching a signal device such as a bell 22 on the cash storing drawer casing 21.

Figure 4:
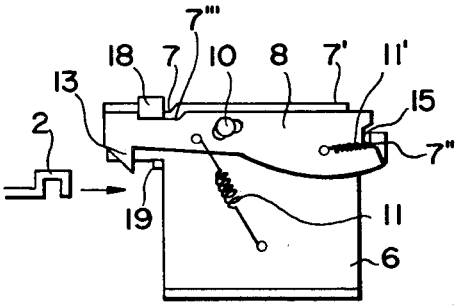
FIGS. 4 and 5 are the left- and right-side views of the latch device before the drawer is pushed in, respectively.
Figure 5:
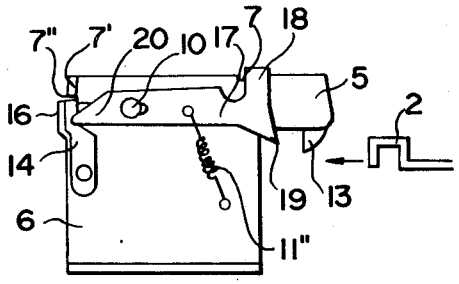
Figure 6:
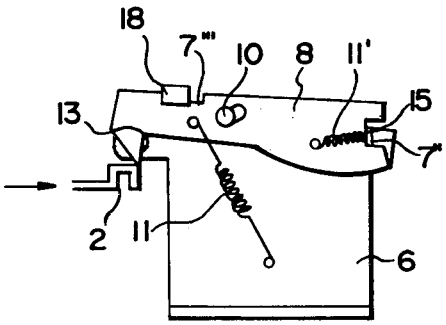
Figure 7:
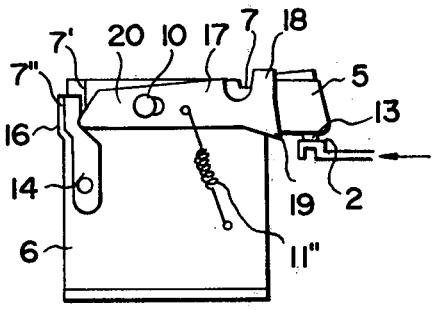
Figure 8:
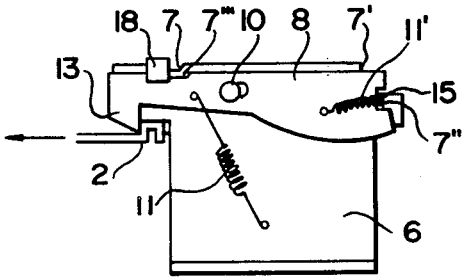
FIGS. 8 and 9 are the left- and right-side views of the latch device when the drawer has been latch-locked.
Figure 9:
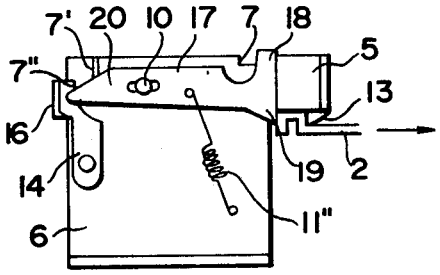
Figure 10:
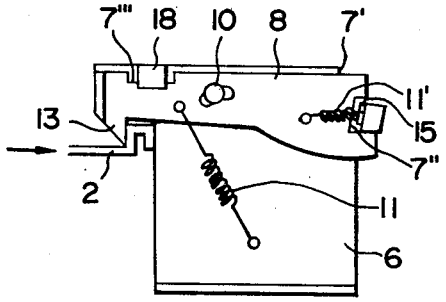
FIGS. 10 and 11 are the left- and right-side views of the latch device when the drawer has been pushed in again.
Figure 11:
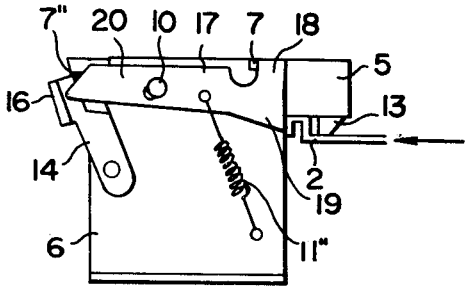
Figure 12:
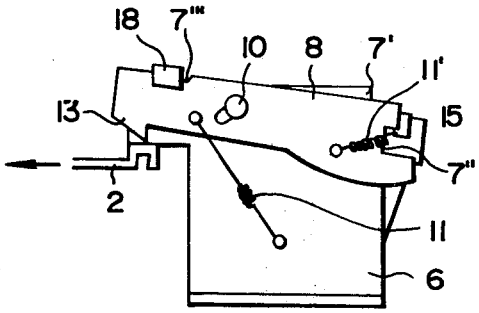
FIGS. 12 and 13 are the left- and right-side views of the latch device when the lock has been released.
Figure 13:
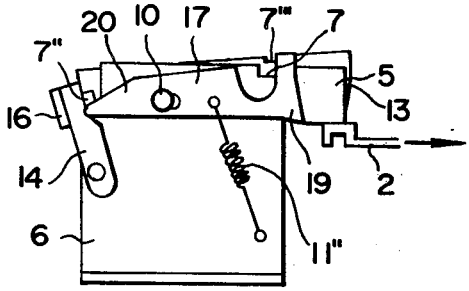
Figure 14:
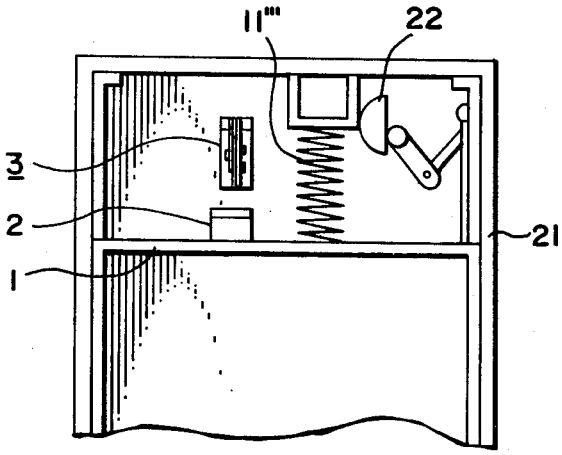
FIG. 14 is a plan view showing the interior structure of a cash storing drawer casing in relation to the present invention.

The function of the present invention in the above structure is accounted for below. The arrow mark indicates the direction in which the stopper 2 moves. First, the cash storing drawer box 1 is pushed into the cash storing drawer casing 21 (FIGS. 4 and 5). The stopper 2, which has a horizontally-prolonged and upward-projected part and is attached on the back wall of the cash storing drawer box 1, receives the hook 13 of the horizontal lever 13, and pushes up the horizontal lever 8 around the latchhook (FIGS. 6 and 7). When the stopper 2 has been fully inserted into the latch device 3, causing the horizontal lever 8 to be given a rotational moment by the spring 11 in the counterclockwise direction in FIG. 8, and resulting in an engagement between the latch-hook 15 and the notch 7, the hook 13 locks the stopper 2 of the cash storing drawer box 1 (FIGS. 8 and 9). In this state the cash storing drawer box 1 cannot be withdrawn. Then, the cash storing drawer box 1 is fully pushed in toward the latch device 3. This push causes the stopper 2 to push the projected part 19 of the lock-releasing lever 17, which, in turn, causes the latch-catching part 20 to come into contact with the hook 16 of the latch component 14, resulting in the latch-hook 15 of the latch component 14 being disengaged from the C-shaped notch 7'' of the horizontal lever 8. The lock-releasing lever 17 is given a rotational moment by the spring 11'' in the clockwise direction in FIG. 11, and the bend 18 keeps the lock-released condition by engaging in both the notch 7 on the upper end plane of the support plate 6 and the notch 7''' (FIGS. 10 and 11). Subsequently, the stopper 2 on the cash storing drawer box 1, which has been pushed by the spring 11''', pushes up the horizontal lever 8 of the latch-hook 15, now in a lock-released conditon, round the rivet 10. This causes the stopper 2 to be released from the latch device 3, resulting in an automatic push-out of the cash storing drawer box 1 by the action of the spring 11'''. At the same time, the bend 18 of the lock-releasing lever 17, which has been engaged in the notch 7 of the support plate 6, is pushed up by the upper edge of the horizontal lever 8 to be disengaged from the notch 7, when the maintenance of the locked state is terminated. As soon as the stopper 2 is released from the latch device 3, the horizontal lever 8 is caused to rotate by the action of the rotational moment given by the spring 11 in the counterclockwise direction in FIG. 12. This causes the hook 13 to descent, and simultaneously the latch-hook 15 of the latch component 14 is caused by the action of the spring 11' to return to the C-shaped notch 7 of the horizontal lever 8; here the initial state defined in FIGS. 4 and 5 is resumed.

The long elliptic holes 9 on both the horizontal lever 8 and the lock-releasing lever 17 may be replaced by simple, rather large round holes. As the springs 11, 11', and 11'', any springs may be used which are capable of effective operations (FIG. 4) of pulling the horizontal lever 8 to the right, rotating it in the counterclockwise direction, pulling the latch component 14 to the left, pulling the lock-releasing leve- 17 to the left, and rotating it in the counterclockwise direction.

The latch device 3 may be positioned, for example, on the left or right inner side of the cash storing drawer casing 21 on its ceiling so long as both the latch device 3 and the stopper may be matched. This is because the latch device 3 is capable of operation only under the action of the springs 11, 11', and 11'', without being influenced at all by gravity.

With the device of the present invention installed, the drawer box is locked when pushed in, and smoothly unlocked and automatically pushed out when pushed again. This operational cycle is repeated endlessly. The horizontal lever, latch component, and lock-releasing lever may all be produced by means of press punching. Thus, components of high durability may be obtained at extremely low cost. There is no need for power supply, wiring, solenoids, etc., for the operation of the drawer, so that the installation as well as assembly of the device is very simple. This device is expected to find a wide range of applications for small-article storing cases, office desks, etc.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

It is claimed:

1. A latch device for a drawer which locks the drawer when it is pushed in and unlocks the drawer when it is again pushed in, which comprises a support plate having a front end portion and a rear end portion, a prolonged element formed on the front end portion of the support plate, a notch formed at the front, upper edge portion of said support plate, a horizontal lever operatively connected to and disposed on one side of the support plate, said horizontal lever containing a hook-like element extending from the front end portion thereof and a notch formed on the rear end portion thereof, spring means connected at one end to the horizontal lever and at the other end to the support plate, said spring applying a downward and rearward tension on the hook-like element, a lock-releasing lever operatively connected to said support plate and disposed on the other side of said support plate from said horizontal lever, said lock-releasing lever containing a projecting portion disposed immediately behind the hook-like element with a U-shaped bend member disposed in the upper front end thereof for extending over the support plate and the horizontal lever and a latch-catching element disposed at the rear end thereof, a spring means attached at one end to the lock releasing lever and at the other end to the support plate for pulling the projecting portion in the forward and downward direction, a latch member disposed on and operatively attached to the rear end portion of the support plate, said latch member being positioned to engage the notch for locking the horizontal level and a spring means attached at one end to the support plate and at the other end to the latch member for applying pressure to the latch member.

* * * * *